US005805038A

United States Patent [19]

Palmer et al.

[11] Patent Number: 5,805,038

[45] Date of Patent: Sep. 8, 1998

[54] SHOCK ABSORBER FOR CIRCUIT BREAKER

[75] Inventors: Kathryn M. Palmer, Sewickley; Stephen A. Mrenna, Beaver; Kevin A. Simms, Eighty-four, all of Pa.

[73] Assignee: Eaton Corporation, Cleveland, Ohio

[21] Appl. No.: 841,731

[22] Filed: Apr. 29, 1997

[51] Int. Cl.[6] ..... H01H 75/10

[52] U.S. Cl. ..... 335/42; 335/35; 335/46; 335/176

[58] Field of Search ..... 335/42, 46, 193, 335/23–25, 35–41, 167–76

[56] References Cited

U.S. PATENT DOCUMENTS

| | | | |
|---|---|---|---|
| 3,849,747 | 11/1974 | Mrenna et al. | 335/166 |
| 4,263,492 | 4/1981 | Maier et al. | 200/288 |
| 4,267,419 | 5/1981 | Maier et al. | 200/288 |
| 4,481,491 | 11/1984 | Heft et al. | 335/21 |
| 4,891,617 | 1/1990 | Beatty, Jr. et al. | 335/46 |
| 4,933,653 | 6/1990 | Mrenna et al. | 335/37 |
| 5,008,645 | 4/1991 | Mrenna | 337/70 |
| 5,430,422 | 7/1995 | Gibson | 335/172 |

*Primary Examiner*—Lincoln Donovan
*Attorney, Agent, or Firm*—Martin J. Moran

[57] ABSTRACT

A circuit breaker has a shock absorber to prevent nuisance tripping which results from shock generated during ON to OFF operation of the circuit breaker. The shock is primarily caused by a snap action which occurs within the operating mechanism of the circuit breaker when the handle is moved from the ON to OFF position. The snap action results from the circuit breaker employing, as part of the operating mechanism, a toggle mechanism within an over center tension spring as a means for imparting motion in the operating mechanism. By strategically positioning the shock absorber for engagement with the operating mechanism when the circuit breaker is in the OFF position, the shock may be effectively absorbed thereby preventing the undesirable nuisance tripping.

19 Claims, 5 Drawing Sheets

SHOCK ABSORBER FOR CIRCUIT BREAKER

BACKGROUND OF THE INVENTION

1. Field of the Invention

The present invention relates generally to circuit breakers, and more particularly, to a circuit breaker having a shock absorber to prevent nuisance tripping which results from shock generated during ON to OFF operation of the circuit breaker.

2. Background Information

Circuit breakers of the type having an operating mechanism and trip means, such as a thermal trip assembly and/or magnetic trip assembly, which are automatically releasable to effect tripping operations and manually resettable following tripping operations are common and generally well known in the art. Examples of such circuit breakers are disclosed in U.S. Pat. Nos. 3,849,747; 4,933,653; and 5,008,645. Such circuit breakers, commonly referred to as "miniature" circuit breakers, have been in use for many years and their design has been refined to provide an effective, reliable circuit breaker which can be easily and economically manufactured on a large scale. In addition, circuit breakers of this type are utilized in conjunction with ground fault mechanisms as well.

Circuit breakers of this type have essentially three stable positions for the operating member or handle: ON, OFF, and TRIPPED. These three positions tell the operator what condition the breaker is operating in when viewed. Thus, when such circuit breakers are in normal operation, the handle is maintained in the ON position. Then once the trip means is automatically released, so as to protect electrical circuitry from damage due to an overcurrent condition such as an overload or relatively high level short circuit, the handle automatically moves to the TRIPPED position. The circuit breaker must then be reset, as is known in the art, by moving the handle beyond the OFF position to a RESET position from which the handle returns to the OFF position when released. The circuit breaker may then be manually operated from the OFF to ON position in order to allow the circuit breaker to resume normal operation. In addition, the handle is manually maneuverable from the ON to OFF position if it is desired to open the protected circuit.

When manually operating a circuit breaker from the ON to OFF position, the possibility exists for nuisance tripping to occur. Instead of the handle going from ON to OFF and remaining in the OFF position, as intended, the circuit breaker is unnecessarily tripped and the handle goes to the TRIPPED position. This nuisance tripping is, obviously, undesirable since normally the circuit breaker should only trip when the breaker detects an electrical fault or overcurrent condition.

There is a need, therefore, for a circuit breaker which prevents undesirable nuisance tripping during manual operation of the circuit breaker handle from the ON to the OFF position.

There is a more particular need for such a circuit breaker that does not affect the normal operation of the circuit breaker's operating and tripping mechanisms.

There is a further need for such a circuit breaker which can be produced economically.

There is yet a further need for such a circuit breaker which can be incorporated into existing circuit breaker designs with minimal modification to the circuit breaker.

SUMMARY OF THE INVENTION

These and other needs are satisfied by the invention which is directed to a circuit breaker having a shock absorber for preventing undesirable nuisance tripping during manual operation of the circuit breaker from the ON position to the OFF position. Advantageously, the shock absorber prevents the nuisance tripping by absorbing shock or impact forces, which are primarily responsible for the nuisance tripping, generated during ON to OFF operation. More specifically, the shock is a result of a snap action which occurs within the operating mechanism portion of the circuit breaker when the handle is moved from the ON to OFF position. This snap action results from the circuit breaker employing, as part of the operating mechanism, a toggle mechanism with an over center tension spring as a means for imparting motion in the operating mechanism. More specifically, as the line of action of the spring is shifted during operation of the handle from the ON to OFF position, the tension in the spring causes the handle to impact the cradle portion of the operating mechanism once the handle reaches the OFF position. This impact in turn generates the shock which tends to cause the nuisance tripping.

Advantageously, by including as part of the circuit breaker a shock absorber strategically positioned in the circuit breaker so as to absorb the shock, the described nuisance tripping may be prevented. Preferably, the shock absorber is positioned so as to engage the cradle. As described, the shock is caused by the handle impacting the cradle. Therefore, by positioning the shock absorber for engagement with the cradle, the shock may be most effectively absorbed. In addition, the shock absorber is preferably made of a resilient material.

In one embodiment, the shock absorber is mounted on a projection extending from the cradle. This projection is impacted by the handle when manually operated from the ON to OFF position and provides for mounting the shock absorber in a location for effectively absorbing the shock. In another embodiment, the shock absorber may be positioned directly on the handle for absorbing the shock when the handle impacts the cradle, or more particularly, when it impacts the projection. In yet another embodiment, the shock absorber may be mounted on a stop or laterally extending tab connected directly or indirectly to the housing and positioned adjacent the cradle to effectively absorb the shock.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

Figure 1:
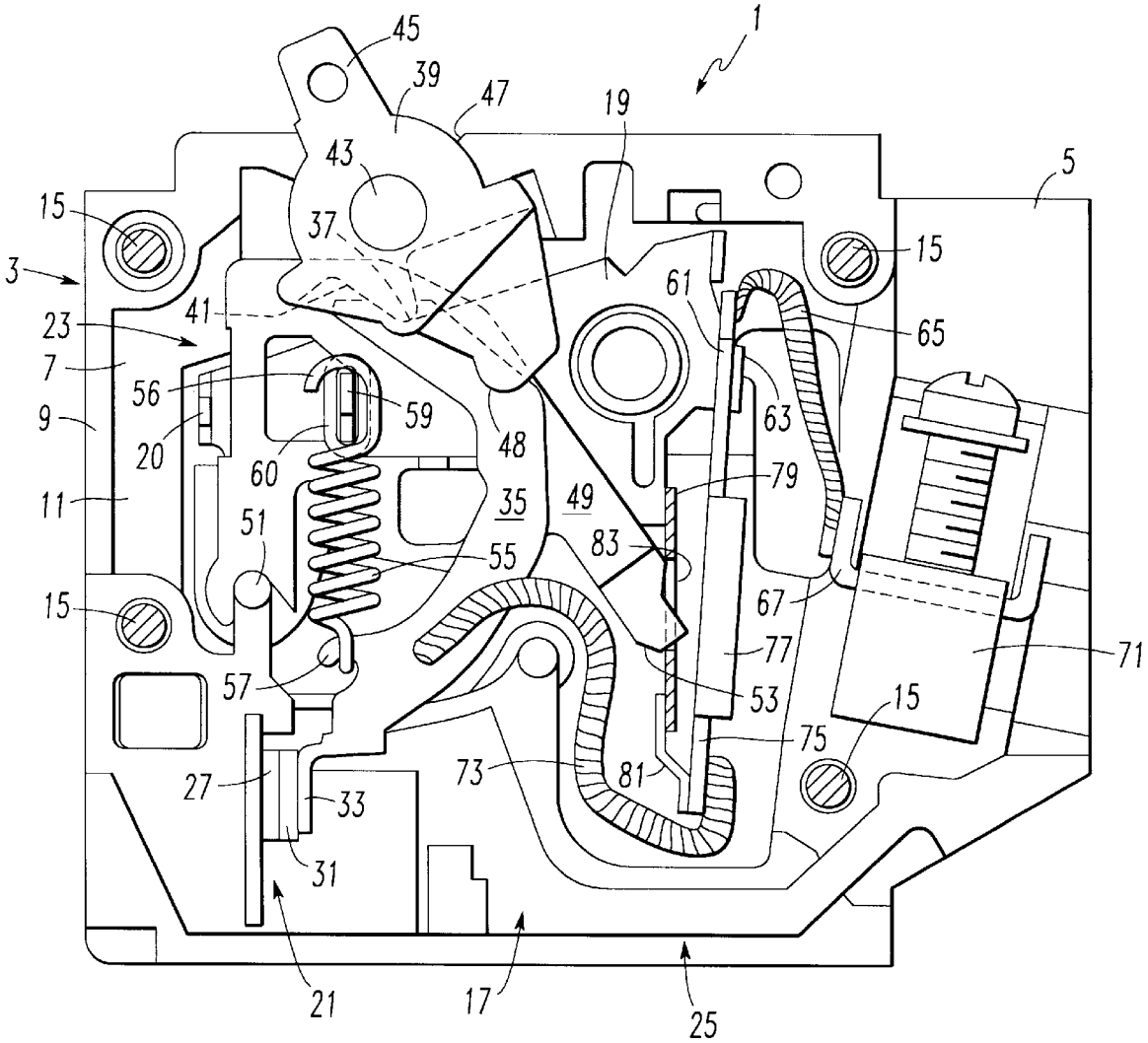
FIG. 1 is a side view of the circuit breaker in accordance with the present invention, with the cover removed and the circuit breaker shown in the ON or closed position.

Referring to the drawings, the circuit breaker 1 of the invention comprises an electrically insulating housing 3 having a molded insulating base 5 having a planar wall 7 and edge walls 9 forming a cavity 11. The housing 3 further includes a molded insulating cover (not shown) which is secured to the base 5 by four rivets 15. A circuit breaker assembly, indicated generally at 17 in FIG. 1, is supported in the cavity 11 of the housing. The circuit breaker assembly 17 includes a support plate 19 having a stop 20, a set of electrical contacts 21, a latchable operating mechanism 23 and trip assembly 25.

The set of electrical contacts 21 includes a stationary contact 27 secured to a plug-in type line terminal (not shown), and a movable contact 31 secured to a small flange 33 on one end of a flat metallic, generally C-shaped contact arm 35 which forms part of the latchable operating mechanism 23. The contact arm 35 is provided at the upper end with a depression 37. A molded insulating operating member 39 has a molded part 41 which engages the depression 37 in the contact arm 35 to provide a driving connection between the operating member 39 and the contact arm 35. The operating member 39 is molded with a pair of pins 43 extending outwardly on opposite sides (only one shown) which fit into bearing openings (not shown) in the base 5 and the cover of the housing 3 to support the operating member 39 for pivoted movement. The operating member 39 includes a handle part 45 which extends through an opening 47 on top of the housing 3 to enable manual operation of the circuit breaker 1. The operating member 39 also includes downwardly extending portion 48 for engaging the latchable operating mechanism 23 so as to provide for resetting the circuit breaker 1 following tripping.

Figure 2:
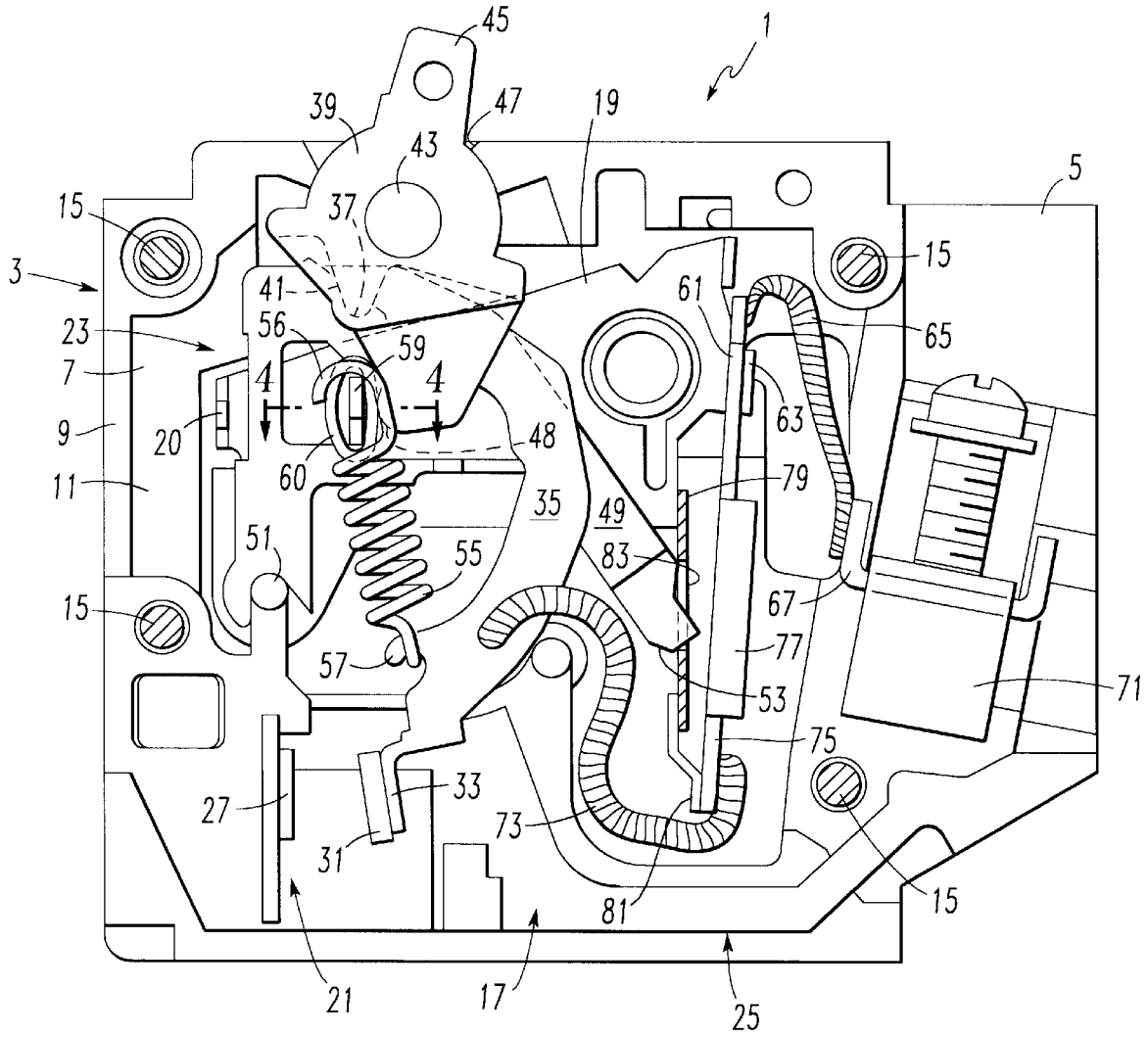
FIG. 2 is a side view of the circuit breaker of FIG. 1 with the circuit breaker shown in the OFF or open position.
Figure 3:
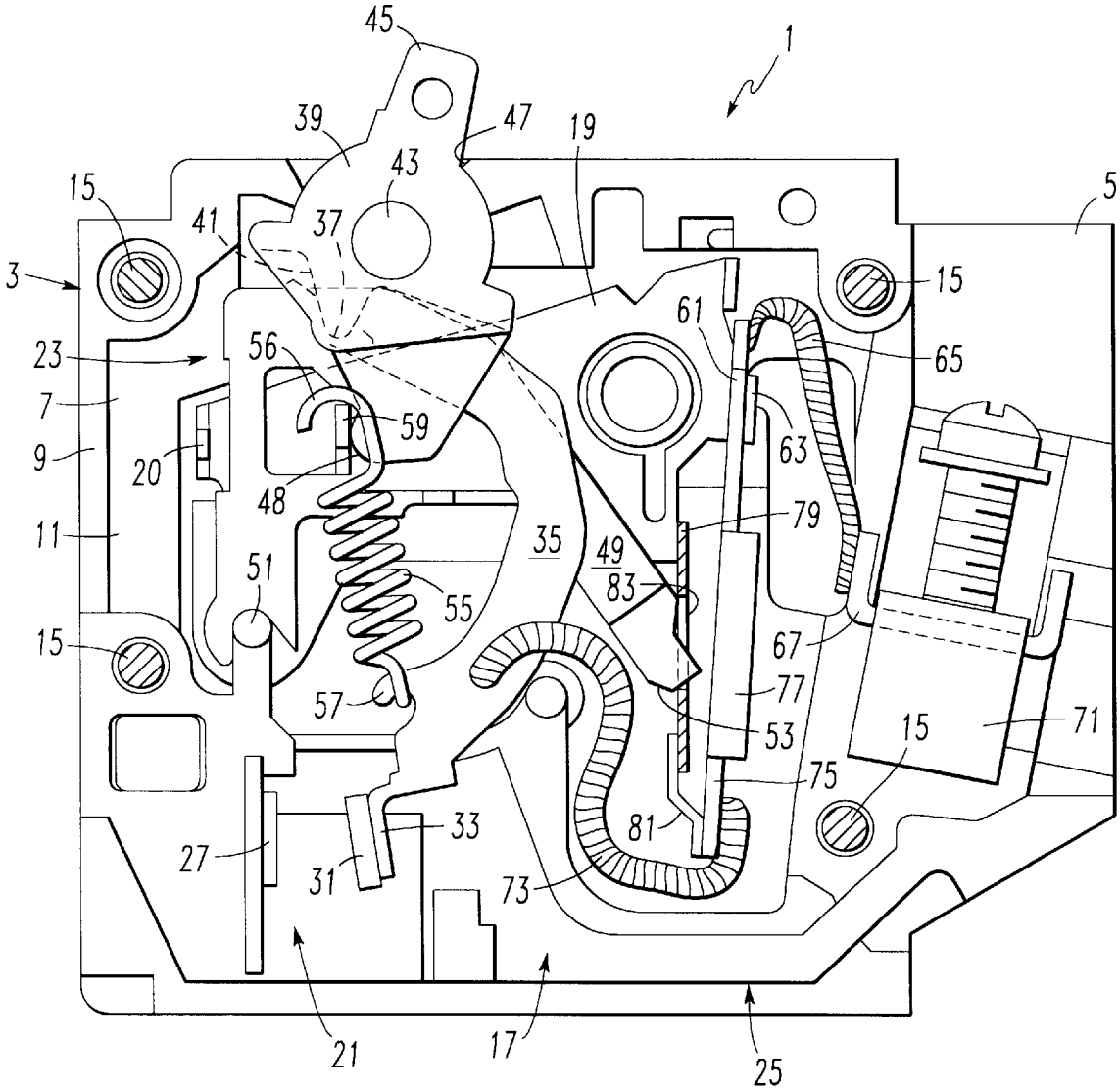
FIG.3 PRIOR ART
FIG. 3 is a side view of a prior art circuit breaker shown in the OFF or open position.
Figure 4:
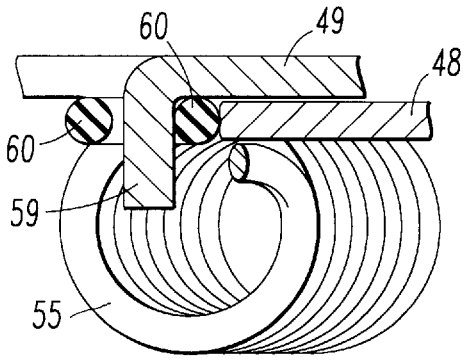
FIG. 4 is a partial sectional view taken along line 4—4 of FIG. 2.

The latchable operating mechanism 23 also includes a cradle 49 supported at one end for pivoted movement on a molded post part 51 of the insulating housing base 5. The other end of the cradle 49 has a latch ledge 53 which is latched by the trip assembly 25, which will be described in more detail herein. An over center tension spring 55 is connected, under tension, at one end to a projection 57 near the lower end of the contact arm 35, and at the upper end thereof to a bent over projection 59 on the cradle 49. In accordance with the present invention, shock absorber 60 may be mounted to projection 59, as shown in FIGS. 1, 2 and 4, to absorb the shock or impact forces resulting from manual operation of the handle 45 of operating member 39 from the ON position to the OFF position, as will be described in more detail herein.

The trip assembly 25 comprises an elongated bimetal member 61 secured, in proximity to its upper end, to a bent over tab part 63 on the support plate 19. A flexible conductor 65 is secured at one end to the upper end of the bimetal member 61 and at the other end to a conductor 67 that extends through an opening in the housing 3 and is part of a solderless terminal connector 71 that is externally accessible and supported in the housing 3 in a well known manner. Another flexible conductor 73 is secured at one end to the free, lower end 75 of the bimetal member 61 and at the other end thereof to the contact arm 35 to electrically connect the contact arm 35 with the bimetal member 61.

The electrical circuit through the circuit breaker 1 extends from the line terminal, through the stationary contact 27, the movable contact 31, the contact arm 35, the flexible conductor 73, the bimetal member 61, the flexible conductor 65, the conductor 67, and the solderless terminal connector 71.

The trip assembly 25 includes a thermal trip capability which responds to persistent low level overcurrents and a magnetic trip capability which responds instantaneously to higher overload currents. The trip assembly 25 includes the bimetal member 61, a magnetic yoke 77 and a magnetic armature 79. The magnetic yoke 77 is a generally U-shaped member secured to the bimetal member 61 at the bight portion of the magnetic yoke 77 with the legs thereof facing the armature 79. The magnetic armature 79 is secured to a supporting spring 81 that is in turn secured at its lower end near the free end 75 of the cantilevered bimetal member 61. Thus, the armature 79 is supported on the bimetal member 61 by the spring 81. The armature 79 has a window opening 83 through which the one end of the cradle 49 extends with the latch ledge 53 on the cradle engaging the edge of the window 83 to latch the latchable operating mechanism 23 in the latched position, as shown in FIG. 1.

Figure 7:
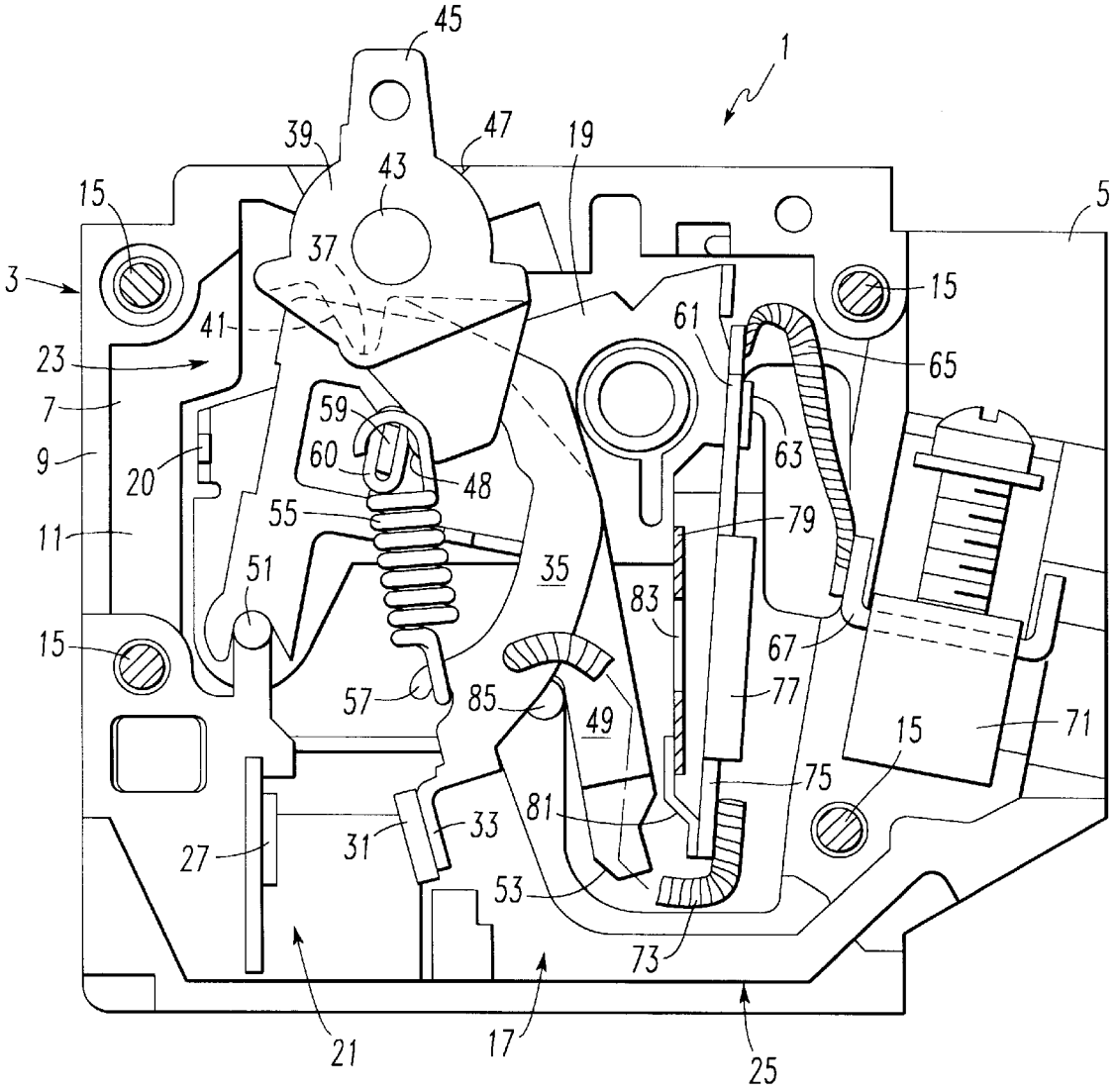
FIG. 7 is a side view of the circuit breaker of FIG. 1 with the circuit breaker shown in the TRIPPED position.

With the circuit breaker in the ON position shown in FIG. 1, a persistent overload current of a predetermined value causes the bimetal member 61 to become heated and deflect to the right as viewed in FIG. 2 to effect a time delayed thermal tripping operation. The armature 79, which is supported on the bimetal member 61 by means of the leaf spring 81, is carried to the right with the bimetal member to release the cradle 49. When the cradle 49 is released, the spring 55 rotates the cradle clockwise on the post 51 until this motion is arrested by the engagement of the cradle with a molded part 85 of the housing base 5. During this movement, the line of action of the spring 55 moves to the right of the point at which the contact arm 35 is pivoted on the operating member 39 to rotate the contact arm counterclockwise to snap the set of electrical contacts 21 open. In addition, the operating member 39 is rotated to position the handle 45 in a position intermediate of the ON and OFF positions to provide a visual indication that the circuit breaker 1 has tripped open, as shown in FIG. 7.

Before the contacts 21 can be closed following an automatic tripping operation, it is necessary to reset and relatch the operating mechanism 23. This is accomplished by moving the operating member 39 clockwise from the intermediate position to a position slightly beyond a full clockwise OFF position (not shown) to relatch the cradle 49. During this movement, due to the engagement of downwardly extending portion 48 of the operating member 39 with the projection 59 of the cradle 49, the cradle is moved counterclockwise about the post 51 until the latch ledge 53 of the cradle is again latched in the window opening 83 of the armature 79. The handle 45 may then be moved in a counterclockwise direction to the ON position shown in FIG. 1 which moves the upper end of the contact arm 35 to the right of the line of action of the spring 55 to snap the contacts 21 to the closed position shown in FIG. 1.

The circuit breaker 1 is magnetically tripped automatically and instantaneously in response to overload currents above a second predetermined value higher than the predetermined value for the thermal trip. Flow of overload current above this higher predetermined value through the bimetal member 61 induces magnetic flux around the bimetal. This flux is concentrated by the magnetic yoke 77 toward the armature 79. Overload current above the second predetermined value generates a magnetic force of such a strength that the armature 79 is attracted toward the magnetic yoke 77 resulting in the flexing of the spring 81 permitting the armature 79 to move to the right to release the cradle 49 and trip the circuit breaker open in the same manner as described with regard to thermal tripping operation. Following a magnetic trip operation, the circuit breaker 1 is reset and relatched in the same manner as described above.

In addition to the handle 45 being manually maneuverable from the OFF position to the ON position in order to place the contacts 21 in a closed position and establish the electrical circuit through the circuit breaker 1 for normal operation as described herein, the circuit breaker 1 may also be manually operated from the ON position to the OFF position thereby placing the contacts 21 in an open position and terminating flow through the circuit breaker and interrupting the electrical circuit. More specifically, when going from the ON position to the OFF position, the handle 45 is moved in a clockwise direction from the handle position as shown in FIG. 1 to the handle position as shown in FIG. 2. Due to the tension which exists in spring 55 to maintain the contacts 21 in the closed position, a sufficient amount of force must be applied to the handle 45 so as to overcome the tension in the spring and allow the handle to move in a clockwise direction. As the force is applied and handle 45 begins to move in the clockwise direction, the upper end of contact arm 35 also begins to move in a counterclockwise direction as a result of the driving connection provided between the molded part 41 of operating member 39 and the depression 37 of contact arm 35. This cooperation between molded part 41 and depression 37 defines a pivot point about which the contact arm 35 is pivoted on the operating member 39 to rotate the contact arm.

During the described counterclockwise movement of the upper end of contact arm 35, the lower end of contact arm 35 begins to move in a counterclockwise direction as well, i.e. the movable contact 31 which is mounted on the contact arm 35 begins to move in a counterclockwise direction away from stationary contact 27. The lower end of spring 55 is also carried in a counterclockwise direction along with the lower end of contact arm 35 due to the spring being connected to projection 57 which is located at the lower end of the contact arm. More specifically, movement of the spring 55 in a counterclockwise direction results in the line of action of the spring moving from a first line of action, as shown in FIG. 1, to the right of the pivot point about which contact arm 35 is pivoted on the operating member 39.

It should be appreciated that the sequence of events described thus far result from a sufficient amount of force being applied to handle 45 so as to overcome the tension in the spring 55. Then, once a sufficient amount of force has been applied to move the line of action of spring 55 to the right of the pivot point, i.e. over center, about which contact arm 35 is pivoted on operating member 39, the amount of tension in the spring begins to decrease, thus carrying the line of action of the spring even further to the right in a counterclockwise direction until finally coming to rest along a second line of action, as shown in FIG. 2. Of course, the lower end of contact arm 35 also continues to move in a counterclockwise direction as a result of projection 57 of the contact arm being connected to spring 55. Once the spring 55 reaches the second line of action and comes to rest, the contact arm 35 also comes to rest. More specifically, once the contact arm 35 comes to rest, the contacts 21 are in the fully open position and the handle 45 is in the OFF position, as shown in FIG. 2.

Once the spring 55 moves to the right of the pivot point, i.e. over center, then no additional force needs to be manually applied to handle 45 in order for the handle to continue to move from the ON position to the OFF position; the spring 55 becomes the driving force for moving the handle 45 to the OFF position as a result of the spring moving to the right of the pivot point and continuing to the right as the tension decreases in the spring. This in turn results in continued movement of the lower end of contact arm 35 in the counterclockwise direction which results in the upper end of the contact arm also moving in a counterclockwise direction and driving the handle 45 of operating member 39 in a clockwise direction until the handle reaches the OFF position. The driving force for moving handle 45 is thus provided by the depression 37 of contact arm 35 pushing against molded part 41 of operating member 39. This pushing action between the depression 37 and molded part 41 is caused by the spring 55 moving to the right causing the lower end of the contact arm 35 to move in a counterclockwise direction and forcing the upper end of the contact arm in a counterclockwise direction and so on, as previously described.

When the handle 45 of operating member 39 is driven to the OFF position as described herein, the downwardly extending portion 48 of operating member 39 impacts the projection 59 on cradle 49. The downwardly extending portion 48 impacts projection 59 as a result of the engagement therebetween when handle 45 is in the OFF position. More specifically, when the handle is moved to the RESET position, which is just to the right of the OFF position, the engagement of the downwardly extending portion 48 with the projection 59 provides a lifting action of the cradle 49 for resetting the latch 53 of operating mechanism 23, as previously described.

The dynamic sequence of events beginning with applying a force to handle 45 and ending with the downwardly extending portion 48 impacting the projection 59 as described herein, results in what is referred to as a "snap" action taking place in the circuit breaker 1. As a result of the snap action, the circuit breaker 1 experiences shock or impact forces which may cause undesirable nuisance tripping to occur during manual operation of the handle 45 from the ON position to the OFF position. More specifically, the snap action tends to cause the latch 53 of the cradle 49 to become disengaged from the window opening 83. Once the latch 53 becomes disengaged, the operating mechanism 23 proceeds to trip as if an electrical fault or overcurrent condition had been detected. Of course, an electrical fault or overcurrent condition is normally not the case when the handle is being manually operated to the OFF position. Once the nuisance tripping occurs, the circuit breaker 1 is in the TRIPPED position, as shown in FIG. 7, and must be reset before the handle 45 can be placed in the OFF position as originally intended.

In accordance with the present invention, circuit breaker 1 is provided with a shock absorber for absorbing the shock resulting from the snap action. The shock absorber is preferably constructed of a resilient material, such as rubber, and is strategically positioned within circuit breaker 1 so as to absorb the shock and diminish the possibility of nuisance tripping occurring. In order to most effectively absorb the shock, the shock absorber is preferably positioned for engagement with the cradle 49. As described, the projection 59 of cradle 49 is impacted by the downwardly extending portion 48 causing the snap action and resulting in the circuit breaker 1, and more specifically the cradle, experiencing shock. In addition, the cradle 49 is integrally formed with the latch 53 which is maintained in window opening 83 of trip assembly 25 on all occasions except when tripped, at which time the latch disengages and falls from the window opening causing the handle 45 to move to the TRIPPED position. Thus, by positioning the shock absorber for engagement with the cradle 49, the shock absorber is located proximate to where the shock is generated and the shock is less likely to contribute to the latch 53 becoming disengaged.

With reference to FIG. 1, there is shown shock absorber 60 which may be mounted directly to projection 59 of cradle 49. Once the handle 45 is manually operated to the OFF position, the shock absorber 60 absorbs the shock which results from the impact of downwardly extending portion 48 against projection 59, as previously described and shown in FIG. 2. This reduces the amount of shock experienced by the circuit breaker 1, and more specifically the amount of shock experienced by cradle 49, and therefore reduces the possibility of nuisance tripping occurring. The shock absorber 60 may be directly mounted to projection 59 by providing the shock absorber in a shape, such as, for example, an O-ring or oval shape, where the shock absorber has an inner periphery which is circumferentially mounted about the projection.

In addition, projection 59 is a common feature of the type of circuit breaker, such as circuit breaker 1, to which the present invention is applicable. Therefore, directly mounting the shock absorber 60 to projection 59, or other common features of circuit breaker 1 as will be discussed in more detail, allows for the shock absorber to be easily incorporated into existing circuit breaker designs with minimal modifications to existing circuit breaker designs. Of course, this translates into lower costs for producing a circuit breaker having a shock absorber.

Advantageously, by mounting the shock absorber 60 directly to projection 59 and beneath the top end 56 of spring 55 (as best shown in FIG. 4) which is also supported by the projection, the top end of the spring secures the shock absorber in position and prevents the shock absorber from becoming dismounted from the projection. However, it should be appreciated that while the embodiment shown in FIG. 1 provides for both shock absorber 60 and the top end 56 of spring 55 to be supported on a single projection 59, other arrangements could be provided, such as, for example, multiple projections with the top end 56 of spring 55 supported on one projection and shock absorber 60 mounted on another projection for engagement by downwardly extending portion 48.

Figure 6:
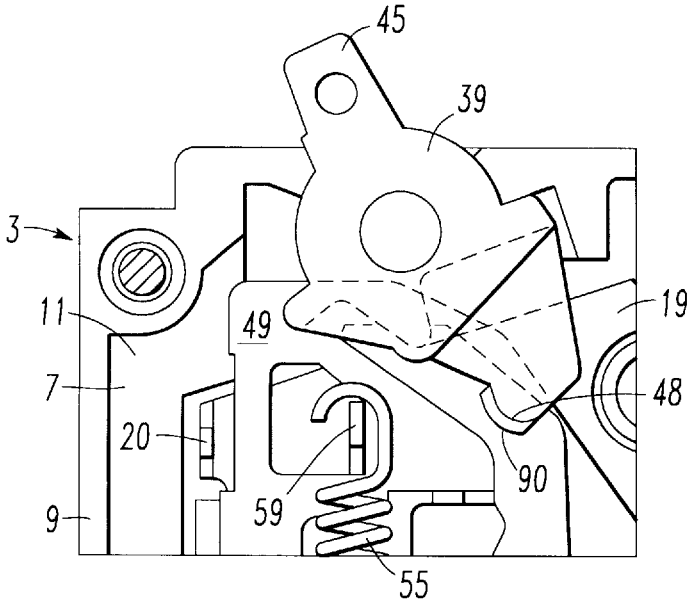
FIG. 6 is a fragmentary view of a portion of a circuit breaker in accordance with a further alternate embodiment of the present invention.

In a further embodiment as shown in FIG. 6, the shock which results from the snap action may be effectively absorbed by mounting a shock absorber 90 directly to the downwardly extending portion 48. Shock absorber 90 acts similar to shock absorber 60 by absorbing the shock which results from downwardly extending portion 48 impacting the projection 59 when the handle is manually operated from the ON to OFF position. It can therefore be appreciated that shock absorber 90 also reduces the possibility of nuisance tripping occurring.

Figure 5:
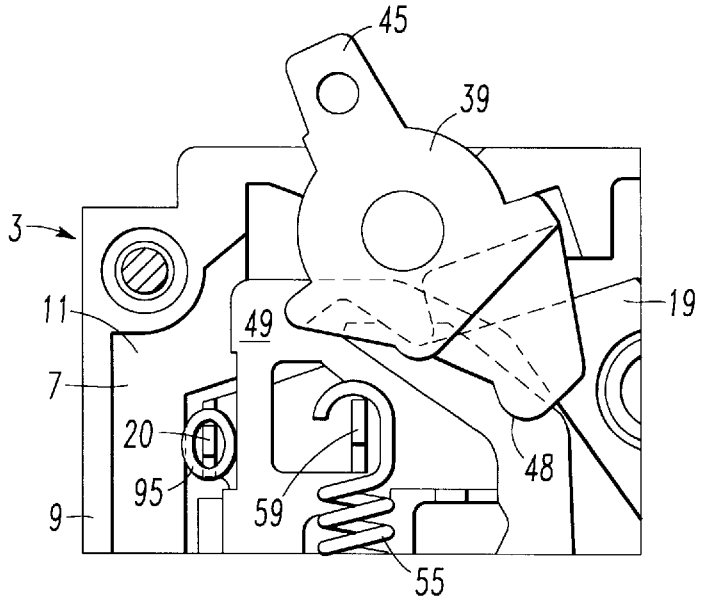
FIG. 5 is a fragmentary view of a portion of a circuit breaker in accordance with an alternate embodiment of the present invention.

In yet another embodiment, a shock absorber may be positioned between cradle 49 and a support arrangement, such as, for example, support plate 19, of the circuit breaker 1 so as to effectively absorb the shock generated during ON to OFF operation of the handle 45. Again, by positioning the shock absorber for engagement with the cradle 49, the possibility of nuisance tripping occurring is greatly diminished. The shock may be absorbed by mounting a shock absorber to either the cradle 49 or a support arrangement, such as the support plate 19. With specific reference to FIG. 5, shock absorber 95 is shown as mounted to a laterally extending tab or stop 20 of support plate 19. The stop 20 limits counterclockwise rotational movement of the cradle 49 during resetting operation of the circuit breaker 1. Thus, when downwardly extending portion 48 impacts projection 59, the cradle 49 tends to move in the counterclockwise direction, similar to the resetting operation, as a result of the impact. The stop 20 is therefore advantageously situated for mounting shock absorber 95 and absorbing the shock created during manual operation from the ON to OFF position.

Shock absorber 95 is preferably made from a resilient material for providing the most effective shock absorption. Shock absorber 95 may be provided in a shape, such as, for example, an O-ring or oval shape, where the shock absorber has an inner periphery which is circumferentially mounted about the stop 20. Furthermore, it should be recognized that the shock absorber 95 could be similarly mounted to other laterally extending tabs or stops (not shown) that may be, for example, integrally formed with the housing 3 and situated proximate to the cradle 49.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker comprising:

an electrically insulating housing;

separable electrical contacts disposed within said housing and movable between a closed position and an open position;

operating means for closing, opening and tripping open said separable contacts, said operating means having an operating member for moving said operating means between an on position wherein said separable contacts are closed, an off position wherein said separable contacts are open, and a reset position which is beyond said off position, said operating means also having a trip position wherein said separable contacts are tripped open;

trip means cooperating with said operating means for sensing an electrical condition of said separable contacts and tripping said operating means to said trip position, in order to trip open said separable contacts in response to a predetermined electrical condition of said separable contacts; and shock absorption means for absorbing shock created when the operating member is moved from said on position to said off position, to prevent tripping of said operating means in response to the shock.

2. The circuit breaker of claim 1 wherein said separable electrical contacts include a fixed contact and a movable contact; and said operating means further includes:

a contact arm supporting said movable contact;

a releasable cradle, means pivotally supporting said cradle in proximity to a first end thereof, said cradle at a second end thereof being latched on said trip means, said shock absorption means preventing said cradle from unlatching in response to the shock;

a spring supported at a first end thereof on said contact arm and at a second end thereof on said cradle; and the operating member operatively connected to said contact arm to permit manual operation between said on position and said off position so as to operate said spring and said contact arm to thereby move said contact arm between said closed position and said open position.

3. The circuit breaker of claim 2 wherein said shock absorption means comprises resilient means which engages said cradle.

4. The circuit breaker of claim 3 wherein said cradle includes a projection extending therefrom, said operating member includes a downwardly extending portion which engages said projection of said cradle when in said off position, said resilient means positioned adjacent said downwardly extending portion and said projection.

5. The circuit breaker of claim 4 wherein said resilient means is mounted on said downwardly extending portion of said operating member.

6. The circuit breaker of claim 4 wherein said resilient means is mounted on said projection of said cradle.

7. The circuit breaker of claim 6 wherein said resilient means includes a shock absorber made of a resilient material.

8. The circuit breaker of claim 7 wherein said shock absorber has an O-ring shape with an inner periphery circumferentially mounted about said projection of said cradle.

9. The circuit breaker of claim 8 wherein the second end of said spring is supported on said projection.

10. The circuit breaker of claim 7 wherein said shock absorber has an oval shape with an inner periphery circumferentially mounted about said projection of said cradle.

11. The circuit breaker of claim 10 wherein the second end of said spring is supported on said projection.

12. The circuit breaker of claim 3 wherein said housing includes a support means mounted therein adjacent to said cradle, said resilient means positioned between said support means and said cradle.

13. The circuit breaker of claim 12 wherein said resilient means is mounted on said cradle.

14. The circuit breaker of claim 12 wherein said support means includes a stopping means positioned in proximity to said cradle, said resilient means mounted on said stopping means.

15. The circuit breaker of claim 12 wherein said housing includes a base having a planar wall and edge walls forming a cavity and a cover enclosing said cavity when the circuit breaker is fully assembled; and said support means includes a support plate mounted in said cavity and extending along said planar wall of the base of said housing, said support plate having a first end portion, a second end portion opposite thereto and connected to said trip means, the first end portion having a laterally extending tab in proximity to the first end of said cradle and butted against said cover to maintain the position of said support plate once said circuit breaker is assembled, said resilient means mounted to said laterally extending tab.

16. The circuit breaker of claim 15 wherein said resilient means includes a shock absorber made of a resilient material.

17. The circuit breaker of claim 16 wherein said shock absorber has an O-ring shape with an inner periphery circumferentially mounted about said laterally extending tab of said support plate.

18. The circuit breaker of claim 16 wherein said shock absorber has an oval shape with an inner periphery circumferentially mounted about said laterally extending tab of said support plate.

19. The circuit breaker of claim 1 wherein said shock absorption means includes a shock absorber made of a resilient material.

* * * * *